United States Patent [19]

Sonneville

[11] Patent Number: 4,494,695

[45] Date of Patent: Jan. 22, 1985

[54] DEVICE FOR AFFIXING A RAIL TO A CONCRETE SUPPORT

[75] Inventor: Roger P. Sonneville, Annapolis, Md.

[73] Assignee: Sonneville International Corporation, Washington, D.C.

[21] Appl. No.: 302,518

[22] Filed: Sep. 16, 1981

[30] Foreign Application Priority Data

Sep. 29, 1980 [FR] France ..... 80 20806

[51] Int. Cl.[3] ..... E01B 9/46

[52] U.S. Cl. ..... 238/265; 238/297; 238/338

[58] Field of Search ..... 238/264, 265, 274, 290, 238/297, 298, 310, 315, 338, 349

[56] References Cited

U.S. PATENT DOCUMENTS

| | | | |
|---|---|---|---|
| 957,641 | 5/1910 | Ashworth | 238/298 |
| 1,103,317 | 7/1914 | Rorke | 238/290 |
| 1,128,668 | 2/1915 | Earll | 238/265 |
| 1,442,701 | 1/1923 | Preston | 238/338 X |
| 1,886,265 | 11/1932 | Andreianov | 238/349 X |
| 2,132,571 | 10/1938 | Maney | 238/349 X |
| 3,451,621 | 6/1969 | De Splinter | 238/315 |
| 3,519,205 | 7/1970 | Monclin et al. | 238/338 |
| 3,576,293 | 4/1971 | Landis | 238/264 X |
| 3,831,842 | 8/1974 | Tamura | 238/310 X |
| 3,957,201 | 5/1976 | Johnson et al. | 238/265 X |
| 4,026,466 | 5/1977 | Duchemin | 238/349 |
| 4,381,076 | 4/1983 | Munier | 238/265 X |

FOREIGN PATENT DOCUMENTS

| | | | |
|---|---|---|---|
| 629812 | 7/1963 | Belgium . | |
| 586358 | 10/1933 | Fed. Rep. of Germany . | |
| 925353 | 3/1955 | Fed. Rep. of Germany . | |
| 1132573 | 7/1962 | Fed. Rep. of Germany | 238/315 |
| 464484 | 11/1913 | France | 238/265 |
| 602044 | 3/1926 | France | 238/265 |
| 7404238 | 10/1974 | Netherlands | 238/265 |
| 36880 | 6/1906 | Switzerland | 238/265 |
| 142881 | 6/1920 | United Kingdom . | |
| 308367 | 1/1930 | United Kingdom . | |
| 379793 | 9/1932 | United Kingdom . | |
| 461178 | 2/1937 | United Kingdom . | |
| 1076719 | 7/1967 | United Kingdom . | |
| 1376929 | 12/1974 | United Kingdom . | |
| 1394796 | 5/1975 | United Kingdom . | |
| 1568400 | 5/1980 | United Kingdom . | |
| 1573247 | 8/1980 | United Kingdom . | |

*Primary Examiner*—Randolph Reese

*Attorney, Agent, or Firm*—Wenderoth, Lind & Ponack

[57] ABSTRACT

A narrow metal plate is embedded in the upper surface of a concrete tie and is curved at one end to form a vertical abutment which projects several centimeters. The plate extends under a rail and is fixedly attached to a tightening bolt which extends through a clip, the end portions of which correspond respectively to the edge of the flange or foot of the rail and the curved end portion of the plate, so that the plate alone supports the tightening forces.

10 Claims, 4 Drawing Figures

DEVICE FOR AFFIXING A RAIL TO A CONCRETE SUPPORT

BACKGROUND OF THE INVENTION

This invention relates to a device for affixing or mounting a rail to a concrete support, such as a tie, and is particularly adapted to troublesome stretches such as, for example, sharp curves.

It is particularly important in stretches of this type that the affixing device prevent all longitudinal displacements of the rail with respect to the tie by means of a very high tightening force of the rail to its support and, in addition, that the device effectively resist against lateral dynamic forces to which the rails are subjected by the wheels, particularly in curves. Prior art affixing devices generally allow the obtainment of only a limited resistance against lateral forces and, most importantly, do not allow for a sufficiently high tightening of the rail to its support.

For example, the device described in U.S. Pat. No. 3,831,842 includes a metallic support having curved end portions forming lateral abutments and is elastically mounted in a recess in the tie, and includes a clip means, tightened by a bolt screwed into a means anchored in the concrete, which abuts, on the one hand, the flange of the rail and, on the other, a centering means carried by the support.

In such a device, the resistance against lateral forces is provided by the support and, in particular, by the edge of the recess in the tie, while the tightening force is supported only by the bolts and, in particular, by the threads of the bolt and the means anchored in the concrete. These elements are not adapted to withstand very high forces and do not provide a sufficient resistance to be appropriate for difficult stretches and for high speed and heavy trains.

SUMMARY OF THE INVENTION

The instant invention has as an object a mounting device which includes a narrow fitting means, in the form of a steel plate, provided with means for anchoring in the concrete, the fitting being set into the tie perpendicular to the general direction of the rail and flush with the surface of the tie, and constitutes a portion of the rail supporting surface, the fitting being rigidly affixed to a tightening means located in its central region and being curved in an upward direction at its end portion furthest from the rail, thereby forming a projection of several centimeters above the surface of the rail, the device also including a clip through which extends the tightening means, the clip being tightened by this tightening means against, on the one hand, the flange of the rail and, on the other hand, against the curved end portion of the fitting means, the clip including, at an end portion, a surface abutting against the flange of the rail and, at its opposite end portion, a curved region corresponding to the form of the fitting means.

The fitting means forms a part of the rail supporting surface and is rigidly affixed to the tightening bolt and, thus, the tightening forces are entirely supported by the fitting means and the totality of the forces on this fitting is in equilibrium, without straining the anchoring means. In other words, upon tightening of the tightening bolt to tighten the clip to the rail and the fitting means, no forces are imparted to the fitting means tending to pull the fitting means and anchoring means from the concrete tie.

In addition, the danger of breakage of the bolt due to the tensions to which it is subjected is compensated by the ease of repair of this bolt by welding, due to the inclusion of the curved portion of the fitting which projects above the tie. This curved portion constitutes, in addition, a sturdy abutment against the lateral forces transmitted by the clip.

According to another embodiment, the means for anchoring the fitting and the bolt constitute a single element with a part anchored in the concrete and traversing the fitting and a part projecting from the exterior of the fitting. The bolt is rigidly affixed to the fitting means so that its lower anchoring part will not be required to support the tightening forces.

The rail is generally supported by two similar mounting devices arranged on either side of the rail, but the fitting means and associated elements can be made of a single unit and have a single narrow metal band curved at its two end portions on either side of the rail.

The following description of the embodiments set forth and seen in the annexed drawings will show more clearly the advantages and characteristics of the invention.

DETAILED DESCRIPTION OF THE INVENTION

Figure 1:
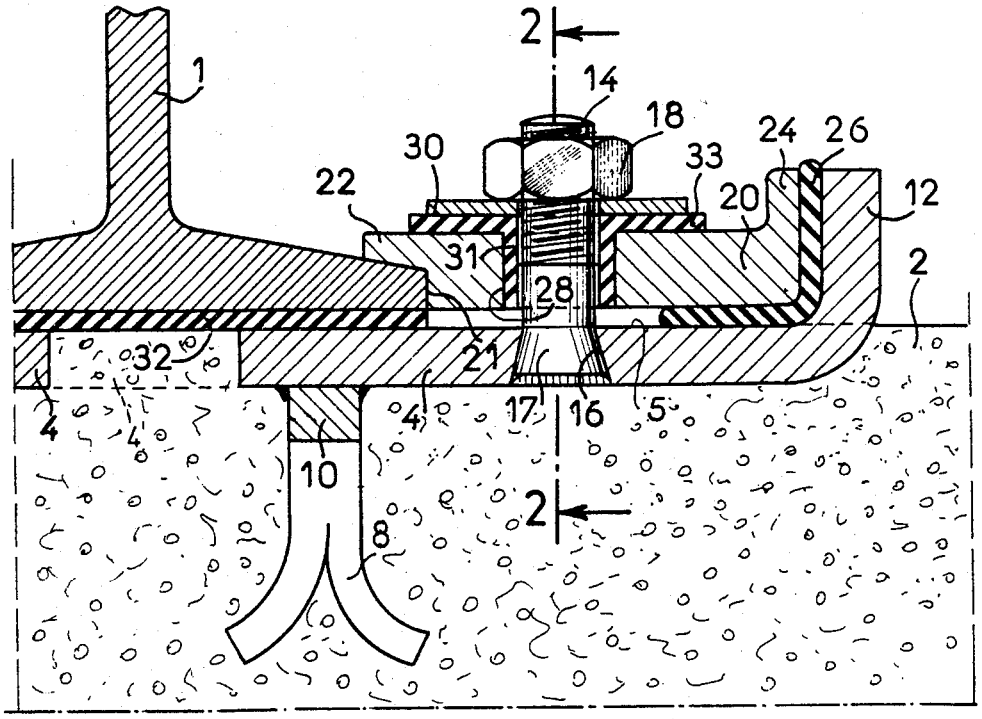
FIG. 1 shows a mounting device for a rail on a concrete tie, according to the invention, in vertical cross-section.
Figure 2:
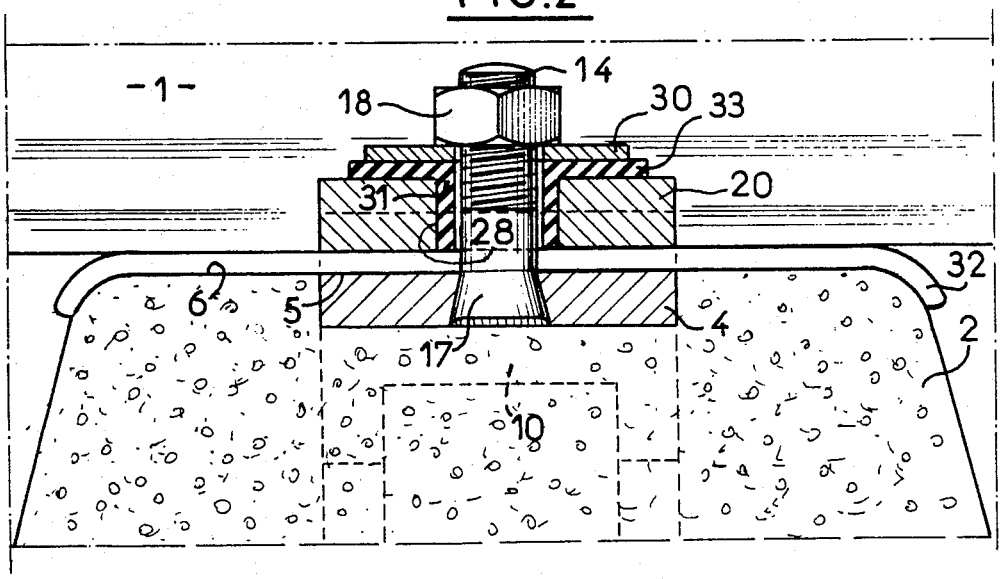
FIG. 2 is a cross-sectional view taken at line 2—2 of FIG. 1.

For effecting mounting or attachment to the flange or foot of the rail 1, the tie, or other concrete support 2, is provided with a narrow fitting 4 which is a relatively rigid, thick, flat, iron plate anchored in the upper portion of the concrete so that its face 5 is flush with the upper level 6 of the cement, as seen in FIGS. 1 and 2. The fitting or plate member 4 is arranged in parallel with the tie 2, its greatest dimension being perpendicular to the longitudinal axis of the rail 1, and its smaller dimension being parallel to this axis. This smaller dimension, or the width, of the plate 4, is substantially smaller than that of the tie 2; it can be, for example, one third of the tie width and preferably is no more than one-half of the tie width.

The plate or fitting member 4 is not only embedded in the upper surface of the concrete 2, but is also anchored into the cement by means of leg members 8 which extend into the concrete and which terminate in an end portion flared out towards the bottom, these legs being, for example, as is seen in FIG. 1, formed of the lateral branches of a brace means 10, soldered to the lower surface of the fitting 4. The fitting extends over the surface area which will support the rail and the brace 10 is preferably affixed under this support portion of the fitting.

At the end of the fitting which is furthest from the brace means 10, that is, at the extremity which is the furthest removed from the flange of the rail, the fitting 4 is curved approximately 90° in an upward direction so as to form an abutment 12 which is substantially parallel to the web of the rail 1 and which extends several centimeters above the upper plane 6 of the tie 2.

The fitting member 4 is also fixedly attached to a bolt or threaded rod 14 anchored in an opening 16 located in the central region of the fitting. Preferably, the bolt 14 is provided with a flared head with the shape of a truncated cone 17, which head fits into hole 16 having a corresponding shape, soldering or heat setting being used to assure an absolute fixed connection between the bolt and the fitting so as to prevent any turning or climbing of the bolt with respect to the fitting.

The bolt 14, together with nut 18, constitutes a means for tightening a fastener or clip 20 to the flange of the rail and to the fitting 4. The clip 20 includes a substantially vertical face 21 which abuts against the lateral edge of the rail flange or foot and includes, at its upper region, a pressure ridge 22 which engages the upper surface of the rail flange or foot, the clip 20 thus overlapping the rail foot adjacent the lateral edge. At the opposite end portion of the clip, there is provided an upwardly extending border, or thickened portion 24, which forms a surface parallel to the abutment 12, against which it may exert pressure. Preferably, however, an elastomer pad 26 is placed between these two members. The pad 26 is preferably in the form of a dihedron and extends above the horizontal surface portion of the fitting 4 upon which the clip 20 exerts pressure. The pad 26 is preferably fixedly mounted on the clip 20 by gluing or other adhesive means. Its thickness is such that the clip will exert pressure only on the pad and on the edge of the flange of the rail through the extension portion or pressure ridge 22 and does not have any other contact with the upper surface 5 of the fitting.

The bolt 14 extends through an opening 28 of the clip 20 and the nut 18 serves to tighten the clip by means of a metallic pressure partition plate 30 as well as plate member 33 made of isolating elastomer which includes cylindrical portion 31 also made of insulating material, the clip thus being electrically isolated from the bolt.

Of course, the rail 1 is preferably mounted on an elastic and/or isolating footing member 32. The rail and footing are supported by the horizontal plane formed by the upper surface 6 of the concrete and the upper surface 5 of the fitting. The rail is maintained laterally in a fixed position by means of the clip 20, the two ends of which abut against the lateral edge of the rail's flange and against the abutment 12 of the fitting, this preventing the rail from moving towards the abutment.

In addition, the rail is tightened against the horizontal plane of the tie and longitudinal movement between the rail and the tie is prevented by means of nut 18 and bolt 14 acting with clip 20. The bolt 14 is fixedly mounted in the fitting 4 such that the tension applied to this bolt during the tightening of the nut on the clip is entirely supported by this fitting 4. This force produces two reactions, one on the rail and the other at the opposite end portion of the clip. The rail is supported directly by the fitting and the end portion of the clip also abuts against the fitting in the area of the upwardly extending abutment 12. Regardless of the clamping force exerted by the bolt, the totality of the forces will thereby be in equilibrium without affecting the means anchoring the fitting into the concrete.

Of course, the fitting will have a thickness and rigidity sufficient to support the flexing forces to which it is subjected. The fitting is preferably constructed of rail steel having a high elastic limit and a natural resistance to corrosion.

The bolt 14 being absolutely fixedly anchored in fitting 4 will have a higher strength than conventional bolts although it will nevertheless remain vulnerable to shocks and the like. This bolt is, however, in electrical contact with abutment 12 which has a substantial elevation above the upper plane of the concrete tie and can thus be utilized as an electrical connection for repairing the bolt by welding. For example, if the threaded part of the bolt 14 has deteriorated, it can be replaced by a pin welded according to a process known under the name "Stud", which permits on the spot repairs. One of the principal disadvantages of rail mounting arrangements utilizing bolts embedded in concrete is thus eliminated.

The dangers of an uprooting from the concrete are also eliminated because of the fact that the anchoring means in the concrete are not placed under strain during the tightening of the nut and are required to support only the dynamic forces corresponding to the mass of the tie suspended from the rail, which could occur if there is poor support under the tie.

Figure 3:
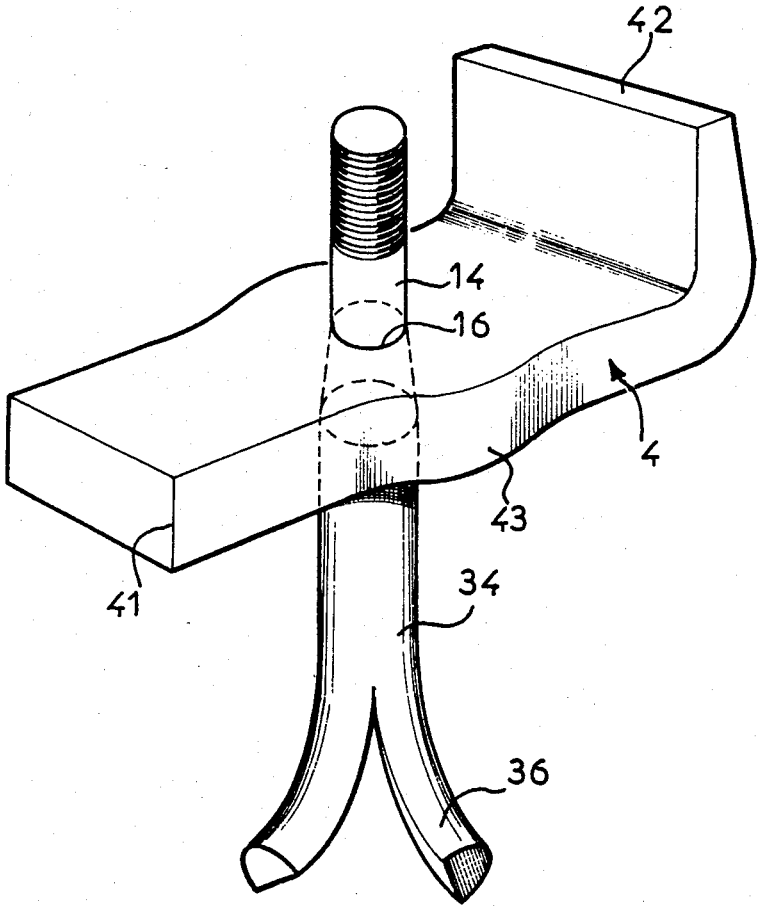
FIG. 3 is an enlarged perspective view of a fitting means according to another embodiment of the invention equipped with anchoring means and tightening means.

The anchoring means can also be constructed as a single unit with bolt 14. The flared head 17 is, in this case, extended by a shank 34 terminating in bedding legs 36, as is seen in FIG. 3. The upper and lower parts of this bolt therefore function independently, the upper portion being the tightening means while the shank 34 and the legs 36 constituting the anchoring means and being unaffected by the tightening function.

Figure 4:
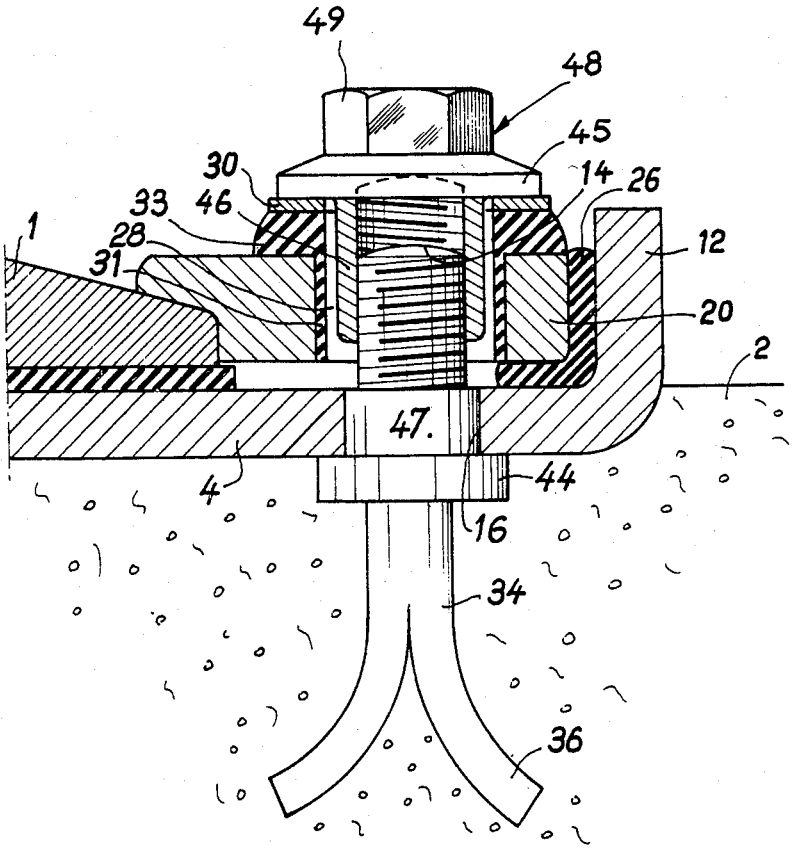
FIG. 4 is a view analogous to that of FIG. 1 of another embodiment of the invention.

According to another embodiment, which is seen in FIG. 4, the truncated cone-shaped head 17 of the tightening means 14 is replaced by a cylindrical head 47 having a shoulder member 44 which abuts against the lower surface of the fitting 4. The hole 16 for this fitting also has a cylindrical form and its diameter corresponds to that of the cylindrical head 47. The bolt is head set or soldered in the fitting, as in the previous embodiments, and collar 44 reinforces the tight joining of these two members and prevents any lifting of the bolt 14 with respect to the fitting during tightening. Of course, this bolt can, like that of FIG. 3, be a single piece with an anchoring shank 34 terminating in legs 36.

In any case, the height of the tightening means above the fitting can be, as seen in FIGS. 1 and 2, greater than that of the abutment 12, or it can be substantially lesser, as is seen in FIG. 4. The tightening nut 48 is preferably a sleeve type, that is, it includes a threaded tubular sleeve 46 forged with the head of the nut 49. The nut 48 also includes an enlarged collar 45, at the junction between the sleeve and the head.

During tightening, the sleeve 46 fits into the opening 28 of the clip 20 within the cylindrical extension 31 of the elastomer plate 33, there remaining a certain amount of play, and is screwed on the threaded portion of the upwardly extending tightening member. The collar 45 is applied against the metallic plate 30 and causes a substantial spreading or expansion of the elastomer plate 33. Such a sleeve nut 48 is particularly effective in protecting the threaded portion of the bolt 14 against shocks and corrosion. In addition, when this threaded element is short in length, it is much less exposed to possible shock since it will be protected by the abutment 12 which is substantially higher than the threaded element.

In addition, the sleeve nut allows for a forceful tightening on the bolt, even if the bolt is very short and does not rise above the clip. In such a case, the clip can also contribute to the protection of the bolt.

Whatever the form of the anchoring means, the fitting 4 can be provided with a uniform transversal cross-section, which is substantially rectangular, and a constant thickness, such as seen in FIGS. 1 and 2. The fitting can, however, be provided with a variable cross-section, with a maximum thickness below the rail and also in the region of the bolt with the fixture thinning and widening at the extremity furthest removed from the rail and at the upwardly bent portion. FIG. 3 shows an example of a fitting of this type which has been formed by a hot forging. The thickness of this fitting decreases in the direction away from the end portion 41 supporting the rail towards the upper end portion of the bent region 42. In addition, adjacent the hole 16 wherein the bolt 14 is anchored, the metal forms two convex lateral projections 43. One thereby obtains a variation in the cross-section of the fitting which corresponds to the bending forces to which this fitting is subjected, thereby rendering the fitting particularly appropriately constructed.

Of course, the rail 1 is preferably affixed to the tie 2 by means of two identical fixation devices. These two devices can be completely independent with the two fittings 4 both extending under the flange of the rail and being separated by the concrete of the tie, as is seen in FIG. 1. The fittings can also be constructed united with each other, the two fittings 4 being formed in a single unit anchored in the surface of the concrete of the tie 2, as indicated by dashed lines at 4' in FIG. 1, and bent at its two extremities to form two abutments 12 parallel to each other which will be located at substantially equal distances from the web of the rail 1. The anchoring means would then preferably be the anchoring legs 36 of the bolts 34 affixed to the fitting in a single unit.

This apparatus is particularly advantageous when the fixation will be subjected to substantial lateral forces, for example, in curves, since the bolts interior and exterior to the railway, being completely embedded in the fitting, contribute to the strength and together support against shearing.

In regard to all of the embodiments, the mounting device thus obtained has a strength much greater than devices currently utilized for concrete ties, particularly against lateral dynamic forces exerted by the wheels on the rails, especially, in sharp curves. In addition, the device will allow very high tightening forces of the rail against the support by taking advantage of bolt tightening without the attendant disadvantages, since this bolt can be easily repaired or replaced, if necessary, and since the additional forces placed on this bolt are not transmitted to the means for anchoring in the concrete. In addition, the manufacture of the device is particularly simple since the preassembled combination, fitting-tightening bolt-anchoring means, is in the surface of the tie. One need only place this combination at the bottom of the concrete mold and provide in the bottom of this mold, slots for the projections 12 and the bolts 14 such that the bottom of the mold exactly corresponds to the surface of the fitting 4 and to the surface of the concrete of the tie 2. The removal from the mold is easily effected and the rail can then be mounted in a conventional manner.

Having now described my invention what I claim as new and desire to secure by Letters Patent is:

1. A structure comprising in combination:

(a) a railway rail including a foot having a lateral edge;

(b) a concrete railway tie disposed under said rail and having an upper surface of a given width longitudinally of the rail and below said rail foot; and (c) a mounting device comprising:

(1) a steel plate interposed between said rail and said tie, said plate having a substantially upright first portion in spaced relation to said lateral edge of said foot of said rail, a substantially horizontal second portion extending from said upright portion to a location beyond the edge of said foot of said rail and under said rail, said plate having a width which is at the most one half of said given width of said upper surface of said tie, said plate being embedded and anchored into the concrete of said tie in a manner resulting from the moulding of the concrete onto said plate, with said plate having an upper surface flush with said upper surface of said tie, so that both said plate and said upper surface of said tie support said rail foot, said plate having a cross section of variable dimensions with the width of said plate increasing in the direction toward said first portion;

(2) anchoring means for anchoring said plate to said tie, said anchoring means being rigid with said plate and embedded in said concrete of said tie in an intimate matter resulting from the moulding of the concrete around said anchoring means;

(3) a soft elastic pad interposed between said rail foot and said upper surface of said plate and said upper surface of said tie vertically below said rail foot for equalizing the pressure of said rail foot on the steel of said plate and the concrete of said tie;

(4) an intermediate clip for maintaining the position of said rail, said clip being interposed between said upright portion of said steel plate and said lateral edge of said rail foot, said clip being in abutting relation to said lateral edge and in overlapping relation to said foot adjacent said lateral edge and in laterally supported relation to said upright portion of said plate; and (5) tightening means for tightening said clip to said rail and to said plate without imparting forces to said plate tending to pull said plate and said anchoring means from said concrete tie, said tightening means including a bolt rigidly fixed to said plate and extending upwardly therefrom through said clip, and a nut threaded onto said bolt above said clip, said bolt having an integral shoulder member abutting a lower surface of said plate;

the position of the application of the laterally outermost force in a downward direction from said clip to said plate being laterally outward of the position of connection between said bolt and said plate and laterally outwardly of the position of connection of said anchoring means to said plate.

2. A structure according to claim 1, wherein said anchoring means comprises a longitudinal extension of said bolt which extends through said plate so that said tightening means and said anchoring means are rigidly fixed to each other.

3. A structure according to claim 2, further comprising an elastomeric plate and a metallic plate mounted between said nut and said clip.

4. A structure according to claim 1, wherein the anchoring means is affixed to said portion of said plate extending under said rail and includes flared legs.

5. A structure according to claim 1, including an elastic layer interposed between said clip and said first portion of said plate.

6. A structure according to claim 1, wherein a second said mounting device is arranged on the other side of said rail.

7. A structure according to claim 6, wherein said two mounting devices are connected by virtue of the horizontal second portions thereof being integral with each other.

8. A structure according to claim 1, wherein said nut includes a threaded sleeve which mounts on said bolt.

9. A structure according to claim 8, wherein said nut includes a collar above said sleeve.

10. A structure according to claim 1, wherein the thickness of said plate decreases in said direction toward said first portion.

* * * * *